United States Patent [19]

Frye

[11] 4,007,695

[45] Feb. 15, 1977

[54] ROTARY HEARTH FURNACE

[76] Inventor: Jim Frye, 4304 N.W. 56th St., Oklahoma City, Okla. 73112

[22] Filed: Oct. 17, 1975

[21] Appl. No.: 623,426

[52] U.S. Cl. ..... 110/13; 110/36; 432/138

[51] Int. Cl.[2] ..... F23G 5/00; F23B 1/24; F27B 9/16

[58] Field of Search ..... 110/13, 36; 432/165 R, 432/137, 138, 139, 244

[56] References Cited

UNITED STATES PATENTS

| | | | |
|---|---|---|---|
| 3,367,644 | 2/1968 | Ban | 432/244 |
| 3,605,656 | 9/1971 | Stribling | 110/13 |
| 3,611,542 | 10/1971 | Moore | 110/13 |
| 3,763,011 | 10/1973 | Allred | 432/138 |

*Primary Examiner*—Kenneth W. Sprague
*Attorney, Agent, or Firm*—William R. Laney

[57] ABSTRACT

A rotary hearth furnace comprising a refractory lined turntable, means for rotating the turntable while retaining the turntable against upward movement, a hood structure covering the upper surface of the turntable and a plurality of adjustably and removably mounted scraper blades supported in said hood structure over the upper surface of said turntable, and positioned to progressively move organic matter to be incinerated, and resting on the turntable, inwardly toward the center thereof, while controlling the depth of the organic matter. The turntable is provided with a central discharge opening for receiving ash materials from the surface of the turntable and discharging them into an ash collection bin, and the hood contains a high temperature heat source which is disposed over the turntable.

22 Claims, 7 Drawing Figures

ROTARY HEARTH FURNACE

BACKGROUND OF THE INVENTION

1. Field of the Invention

This invention relates to waste disposal systems, and more particularly, to a refractory hearth system of the type which includes a rotary turntable upon which is deposited organic material to be incinerated, and thereby reduced to ashes and/or simpler organic components.

2. Brief Description of the Prior Art

A number of types of rotary hearth furnaces which utilize rotating heated surfaces and material treatment methods have been heretofore used, as well as proposed. Some of these systems are large, heavy and expensive permanent installations used in industrial processes in which very large volumes of material to be treated are continuously charged to the furnace and the products of treatment continuously removed therefrom. In some installations, a rotary hearth furnace is used to incinerate organic waste materials and thereby reduce such waste to a more easily and safely disposable form. In other systems, the furnace is particularly designed and used for calcining or for dehydrating inorganic materials.

One of the more recent proposals for a rotary hearth furnace of the type described is that which is set forth in Stribling, U.S. Pat. No. 3,605,656. The structure disclosed in the Stribling patent is used for burning waste products, including partially compressed sludge cakes from sewage processes as well as refuse from municipalities. A rotary, refractory lined hearth is provided which has a central axial discharge for moving ash materials through a tubular vertical discharge pipe at the center of the hearth turntable. The organic materials to be incinerated are charged to the outer periphery of the rotary hearth, and a plurality of plows are disposed over the upper surface of the hearth. These plows function to sequentially direct the organic material carried on the upper surface of the hearth toward the central axial discharge pipe at the center of the hearth. The plows can be varied in their angular relationship above the hearth to selectively provide for one or several revolutions of the material being incinerated prior to its discharge at the center of the hearth. Tangential combustion air inlets and burners are provided around and over the hearth to provide for the heating of the material on the upper surface of the hearth.

In Martin, U.S. Pat. No. 2,676,006, organic material to be incinerated is introduced to the top of a rotary, refractory lined turntable via a duct adjacent the outer periphery of the turntable. A central axial discharge chute is provided at the center of the hearth, with such discharge chute or duct passing through a gas seal trap into a collection duct. Martin, like Stribling, employs tangential burners firing into the enclosed chamber above the rotating hearth. A plurality of rabble blades are provided over the rotating hearth to deflect deposited materials carried on the hearth in a radially inward direction so that ultimately, after one or a plurality of revolutions, the incinerated material will be discharged through the axially discharging duct at the center of the furnace.

Other patents which disclose various constructions of rotary hearth furnaces include U.S. Pat. No. 1,436,520 to Oliver, in which a rotary hearth within a refractory lined hood is provided for the purpose of calcining hydromagnesite; U.S. Pat. No. 630,510 to Keiper in which a rotary hearth-type furnace is provided for roasting ores; U.S. Pat. No. 551,342 in which a plurality of vertically tiered hearth plates are employed in conjunction with scraper blades acting on garbage sequentially deposited on the several plates for the purpose of cremating the garbage; Lewers, U.S. Pat. No. 2,061,708, and Ab-der Halden, U.S. Pat. No. 1,878,581; in which a revolving hearth cooperates with stationary rakes and also with blades or vanes to both stir a material carried on the hearth for incineration purposes, and move it radially inwardly toward a central axial discharge opening in the hearth.

General Description of the Present Invention

The present invention is a thermal device for continuously heating or incinerating relatively small volumes of organic waste material produced generally, though not necessarily, intermittently and at locations where the supporting structure for the thermal device is not stable, such as on boats, ships or large moving vehicles. An important, though not exclusive, application of the furnace device of the invention is in the total incineration of solid and semi-solid human waste produced by numbers of people in a confined working location or the like, such as on shipboard, or on an off-shore drilling platform.

The use of incineration to dispose of human waste is not new, and several thermal commodes are on the market which use either gas, fuel oil or electric infrared lamps as heat sources. In general, such systems have thus far met with limited success for several reasons. Often, the deposition of the waste on the hearth or burning surface is local and concentrated, so that rapid and complete incineration and combustion is difficult. Also deposition of the waste is usually made cyclically during periodic peak periods which causes build-up at the time of maximum deposition, and prevents rapid, uniform combustion. Further, in such systems, deposition of the organic material to be incinerated is frequently made initially upon relatively cold surfaces before the heating elements have been energized or actuated. A warm-up period of about a half hour is often required, during which time more material can enter the furnace and greatly upset the system heat transfer efficiency. In general, the described conditions create problems of inefficient, incomplete combustion with the undesirably concomitant production of smoke and noxious odors.

The present invention minimizes or completely eliminates the described problems through the novel structure employed, and the manner of charging the waste material to be incinerated to the structure and moving it through the system to the point of discharge. Generally and broadly described, the rotary hearth furnace of the present invention comprises a refractory lined turntable which is driven in rotation by a suitable drive means disposed in driving engagement with the turntable, and means for preventing the turntable from moving or shifting upwardly or downwardly by significant degree during the vibration, pitching or rolling of the supporting platform or other structure upon which the system is mounted. A hood structure covers the upper surface of the turntable, and a plurality of adjustably and removably mounted scraper blades are supported in the hood structure over the upper surface of the turntable. The scraper blades are positioned to progressively move organic matter to be incinerated, and resting on the turntable, inwardly toward the center thereof, while controlling in a precise fashion, the depth of the organic matter carried thereon. The turntable is provided with a central discharge opening for removing ash materials from the surface of the turntable, and discharging them into an ash collection bin. The hood contains a high temperature heat source which is disposed over the turntable.

In the use of the described structure, the material to be subjected to incineration is charged by gravity onto the slowly rotating refractory lined turntable, either in bulk or after reduction in a comminuter. Here the material tends to flatten, due to its viscosity, into a relatively thin bed on the turntable. A first or primary bar or blade disposed over the turntable and within the hood structure confines the organic material to an area which is fairly close to the inlet from which it is charged to the turntable until it is carried by the rotary motion of the turntable through a precisely located cut-out or relief disposed along the superjacent edge of the scraper bar. The height of the cut-out section determines the maximum bed thickness which leaves the confines of the inlet area.

The material to be incinerated is then carried around the periphery of the turntable during which it is subjected to a high temperature from the action of the burners or infra-red lamps located within the hood structure. As the material is carried around on the turntable, it encounters two cut-outs or reliefs in a second scraper blade mounted over the turntable surface. The upper edges of these slots or cut-outs are formed more closely to the surface of the turntable hearth than is characteristic of the slot in the primary scraper blade, thus further reducing the depth of the bed of material carried on the turntable.

After the material has completed nearly 300° of travel as the turntable rotates, it is substantially completely dried, is much reduced in volume and has been largely reduced by combustion to ash material. The material in this form is prevented from mixing with raw material being charged to the opposite side of the turntable by the interposition of the opposite side of the primary scraper bar which deflects the incinerated material onto a new path just inside the outer periphery of the turntable. The action of the scraper bar at this location also functions to turn over the material on the surface of the turntable, thus exposing fresh surfaces of organic material. Eventually, the material completes a second circuit on the turntable by which time substantially all combustibles have been reduced to sterile ashes. The secondary scraper blade functions at this time to encounter the rotating residue, and move it into the central opening in the turntable, through which the residue drops into a suitable collection system located below the turntable.

It is an important object of the present invention, among many objects, to provide a compact, mechanically strong and sturdy rotary hearth furnace which is sufficiently compact in size that it can be used in portable installations such as ships and large vehicles.

Another objective of the present invention is to provide a rotary hearth furnace in which the turntable carrying the refractory constituting the hearth is mounted on a vertical supporting structure so that the turntable cannot ride up as the supporting platform or base upon which the unit is installed pitches, jostles or vibrates, and thus, damaging contact of the hearth surface with the scraper blades which are provided is obviated.

An additional object of the present invention is to provide a rotary hearth furnace operated so that a fresh surface on the hearth is continuously provided for the deposition of organic material which is to be incinerated in the furnace, no matter when the organic material is developed and delivered to the furnace.

An additional object of the invention is to provide a portable and compact incinerating unit for disposing of human waste, which unit does not require any warm-up period prior to the deposition of waste thereon, and which reduces such waste to a relatively small quantity of ashes in a relatively short time.

Another object of the invention is to provide a rotary hearth furnace in which a rotating turntable is mounted inside a confining hood, with the turntable to hood interface being so defined that a positive seal against the atmosphere is easily achieved, thus allowing precise adjustment of the volumes of air entering the combustion zone within the furnace.

A further object of the invention is to provide a rotary hearth furnace in which a turntable to hood interface is provided such that a slight vacuum can be maintained inside of the combustion chamber over the rotary hearth provided therein so as to retain odorous gases within the furnace, and improve the dehydration characteristics of the furnace by lowering the internal pressure therein below atmospheric pressure.

Additional objects and advantages of the invention will become apparent as the following detailed description of a preferred embodiment of the invention is read in conjunction with a perusal of the accompanying drawings which illustrate the invention.

GENERAL DESCRIPTION OF THE DRAWINGS

FIG. 1 is a front elevation view of the rotary hearth furnace of the invention, illustrating schematically the conduits or lines used for charging to the furnace, the raw material to be incinerated therein, for charging combustion air used for mixing with a fuel to be fired within the furnace to provide the required heat source, and dilution air which is drawn through the furnace to precisely control the thermal environment therein.

FIG. 6 is an enlarged sectional detail view illustrating the seal interface between the turntable and the hood structure forming a part of the present invention, and illustrating, in cross-section, one of the scraper blades utilized in the invention.

DETAILED DESCRIPTION OF A PREFERRED EMBODIMENT OF THE INVENTION

Figure 1:
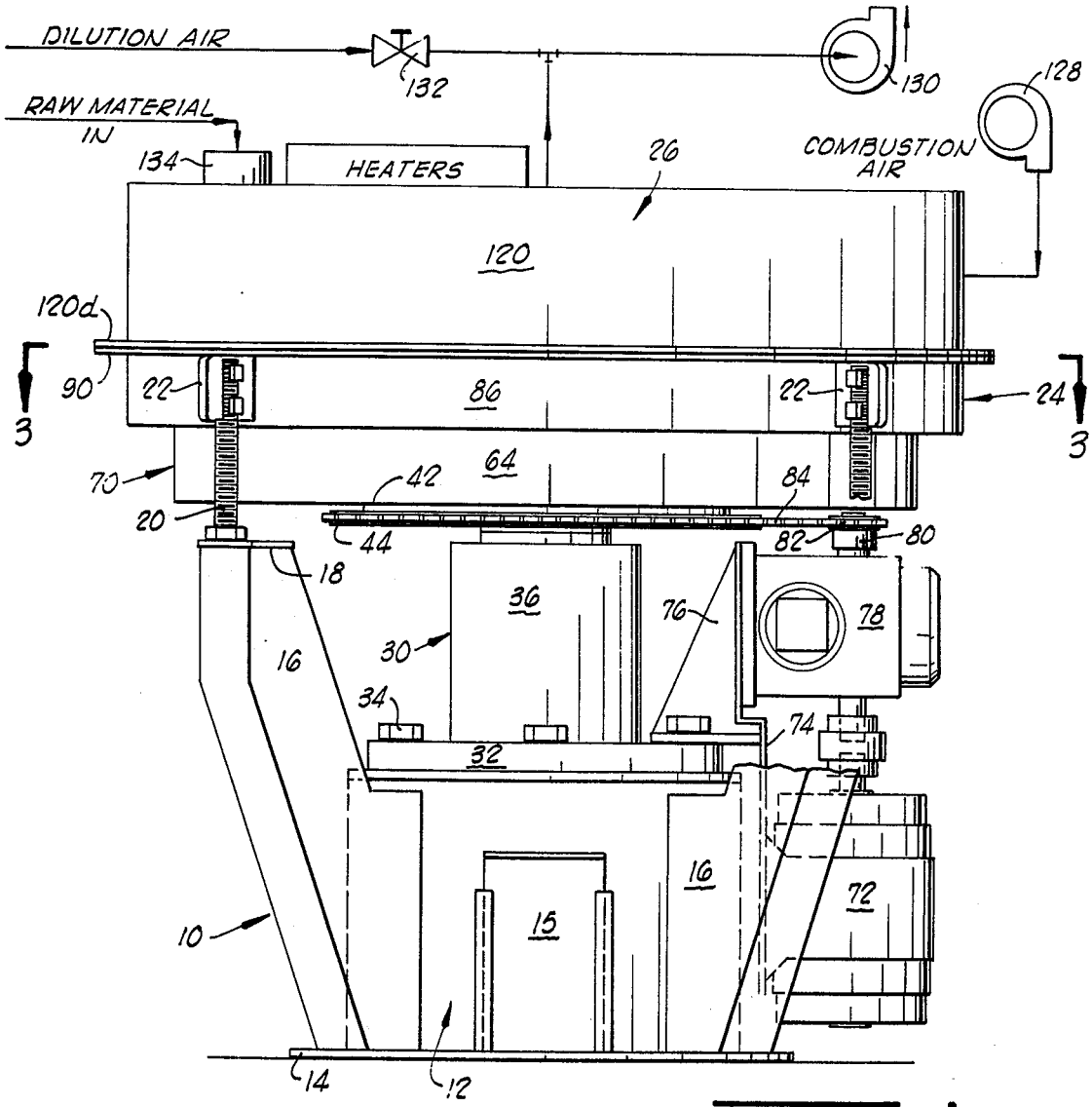
Figure 5:
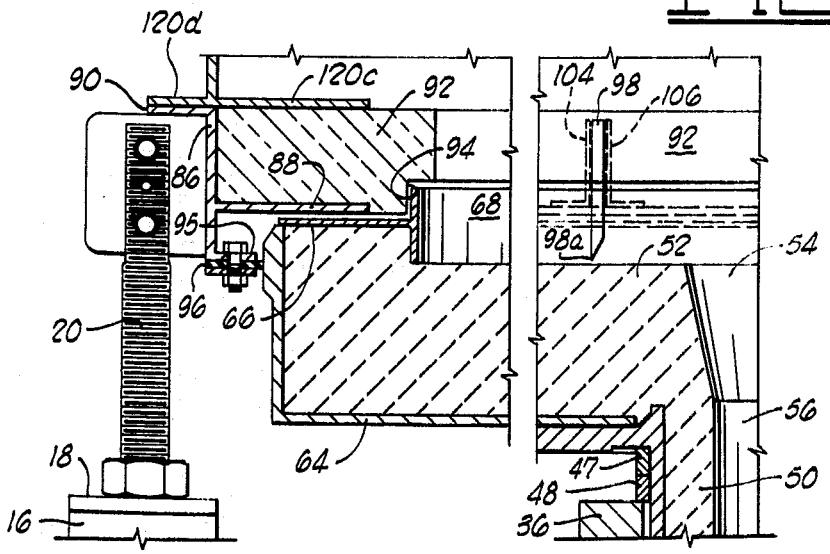
FIG. 5 is a sectional view taken along line 5—5 of FIG. 3.

Referring initially to FIG. 1, the rotary hearth furnace of the invention includes a common mounting base-ash collector substructure designated generally by reference numeral 10. The mounting base-ash collector substructure 10 includes an ash collector housing 12 mounted upon a base plate 14. A vertically sliding door 15 provides access to the interior of the ash collector housing 12. The substructure also includes a plurality of pedestal wings 16 which each project outwardly and upwardly from the housing 12. Each wing 16 terminates at its upper end in a flat surface to which is secured a bed plate 18. In the illustrated embodiment of the invention, four of the pedestal wings 16 are provided and are spaced around the ash collector housing 12.

A large threaded, vertically projecting supporting bolt 20 is secured to each of the bed plates 18 and has its upper end threadedly engaged with an adjusting flange 22 which is secured to the side of, and projects radially outwardly from, a hood adapter designated generally by reference numeral 24. A hood 26 is bolted to the hood adapter 24.

Bolted to the upper side or roof of the ash collector housing 12 is a flanged, vertically extending sleeve 30. The flanged, vertically extending sleeve 30 includes a horizontally extending annular flange 32 which is bolted to the upper side of the housing 12 by suitable bolts 34, and a vertically extending tubular member or sleeve 36 which projects upwardly directly beneath the central portion of the annular hood 26. Confined within the sleeve 36 is a vertical flange bearing 38 (see FIG. 2), and a metallic refractory retainer sleeve 40 is positioned rotatably inside the flange bearing 38. The sleeve 40 carries at its upper end, a horizontally extending, annular turntable supporting plate 42 which has bolted to the lower side thereof and around the outer periphery, a large sprocket 44. The sprocket 44 includes a plurality of teeth 46 secured around the outer edge thereof.

Figure 7:
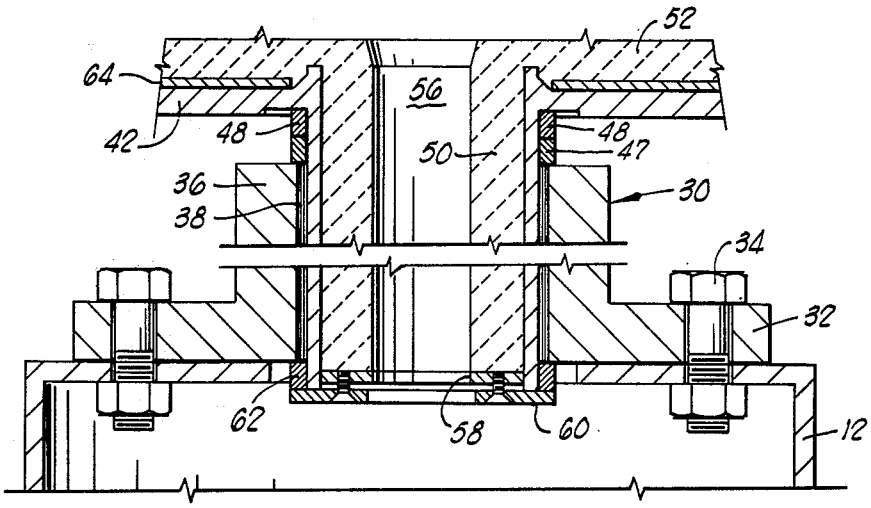
FIG. 7 is an enlarged view of the central axial chute from which ashes are conveyed from the upper surface of the hearth, and illustrating the thrust bearings used for preventing the turntable from moving upwardly or downwardly upon pitching or rolling of the supporting platform or structure on which the rotary hearth is mounted.

Mounted between the vertical flange bearing 38 and the turntable supporting plate 42 are a pair of thrust washers 47 and 48 (see FIGS. 6 and 7). A thick tube 50 of refractory material lines the sleeve 40 and is molded integrally with a round refractory table 52 which has a central opening 54 therein communicating with the axial bore 56 through the tube 50. At its lower end, the tube of refractory material has an annular metallic plate 58 bonded thereto and secured inside the sleeve 40 (see FIG. 7). An annular thrust plate 60 is detachably secured to the annular metallic plate 58, and the peripheral portion projects radially outwardly from the sleeve 40 and supports a downwardly acting thrust washer 62. A metallic refractory housing 64 extends beneath the refractory table 52, and around the sides thereof, and further includes a horizontally extending upper annular flange portion 66 which terminates at its radially inner end edge in a vertically projecting sealing flange 68. The refractory housing 64 is welded or otherwise suitably secured to the turntable supporting plate 42.

It will be perceived from the description thus far that a refractory lined turntable, designated generally by reference numeral 70, is constituted by the metallic refractory housing 64 and the refractory table 52 enclosed therein. The turntable 70, as thus constituted, is supported for rotation within the centrally bored flanged sleeve 30 therebelow, which sleeve encloses the vertical flange bearing 38 within which the sleeve 40 turns. The thrust washers 46 and 48 prevent the turntable 70 from riding downwardly within its supporting bearing structure, and the thrust washer 62 prevents the turntable from riding upwardly during rocking, jostling or vibratory movements of the base or supporting platform upon which the rotary hearth furnace of the invention is mounted.

For the purpose of driving the turntable in rotation, a suitable motor 72 is mounted on the depending plate 74 which is secured to a mounting bracket 76 bolted to the upper side of the horizontally extending annular flange 32. A gear reduction box 78 is also supported by the bracket 76 over, and in alignment with, the motor 72. An output shaft 80 from the gear reduction box carries a drive sprocket 82. The drive sprocket 82 drivingly engages a chain 84 which passes around the sprocket 44 bolted to the underside of the turntable supporting plate 42.

Figure 2:
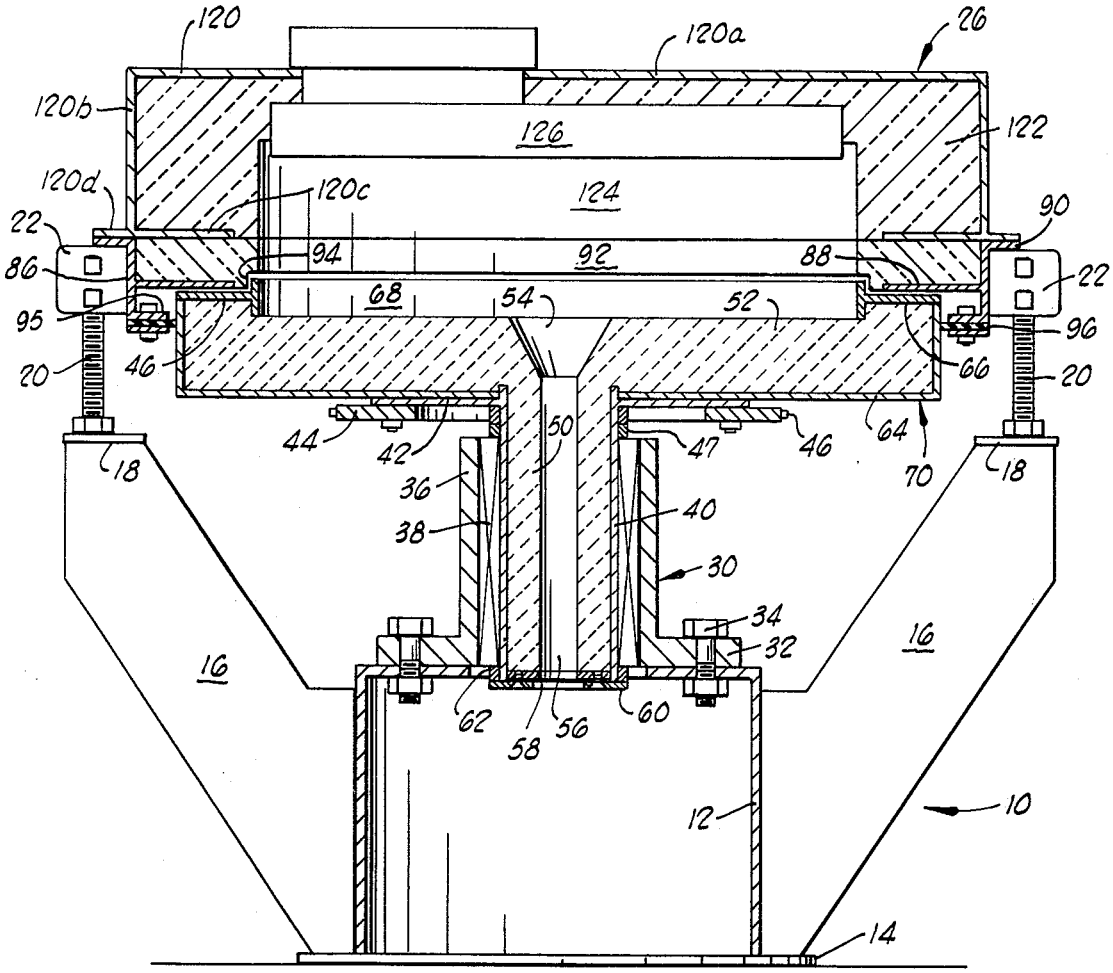
FIG. 2 is a vertical sectional view through the center of the rotary hearth furnace.

The construction of the hood adapter 24 and the annular hood 26 are best illustrated in FIGS. 2–5 of the drawings. As shown in FIG. 2, the hood adapter 24 includes an annular, vertically extending rim 86 which has projecting from the inner side thereof in a horizontal direction, a refractory supporting flange 88. Projecting radially outwardly from the top edge of the rim 86 is a second horizontally projecting annular flange 90. An annular block of refractory material 92 is supported upon the flange 88 and has a relief or shoulder 94 formed therein for mating alignment with the vertically extending sealing flange 68 which is secured to the metallic refractory housing 64 in the manner hereinbefore described. It will be noted in referring to FIG. 2 that the adjusting flanges 22 are welded or otherwise suitably secured in the angle formed between the rim 86 and the annular flange 90. An annular, horizontally extending seal-supporting flange 95 projects radially inwardly from the lower end of the rim 86 and has an annular elastomeric sealing gasket 96 secured thereto and extending into contact with the refractory housing 64.

Figure 3:
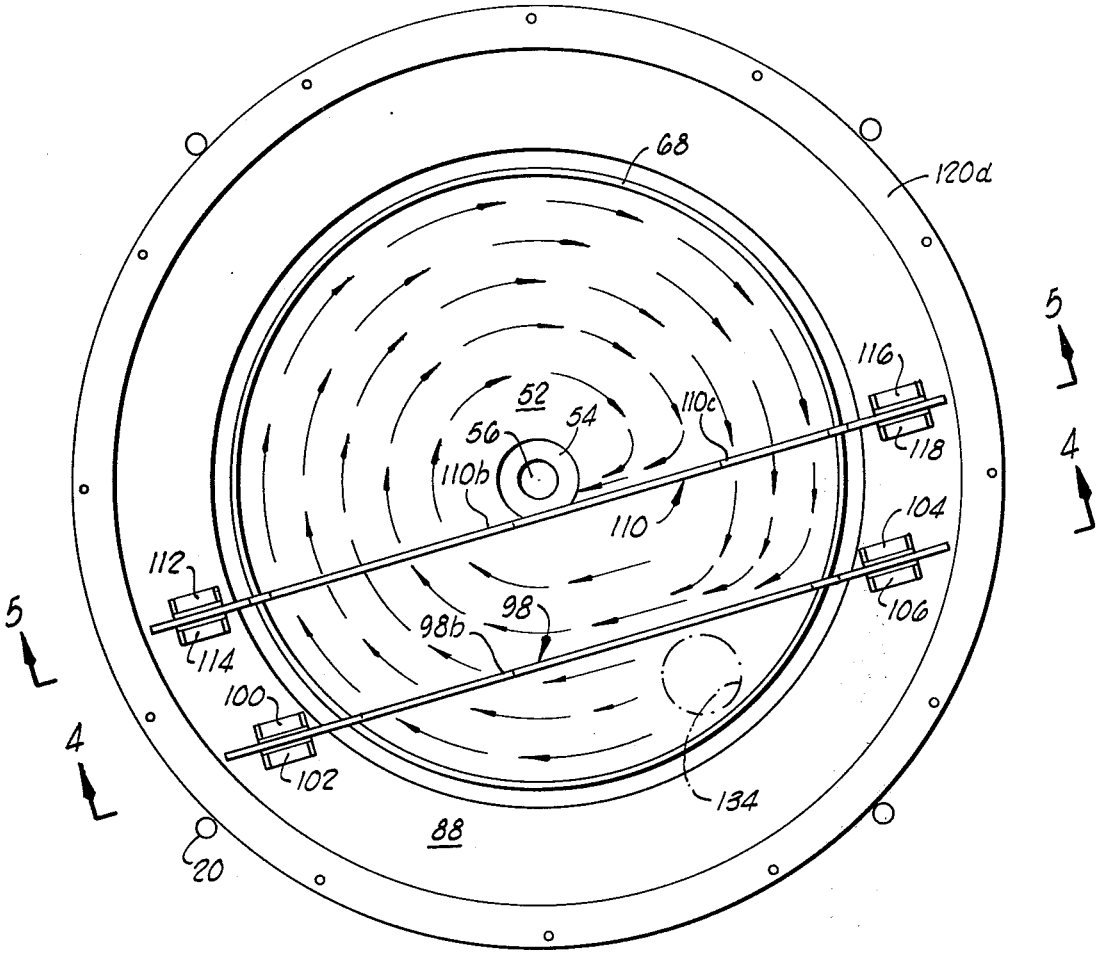
FIG. 3 is a sectional view taken along line 3—3 of FIG. 1.
Figure 5:
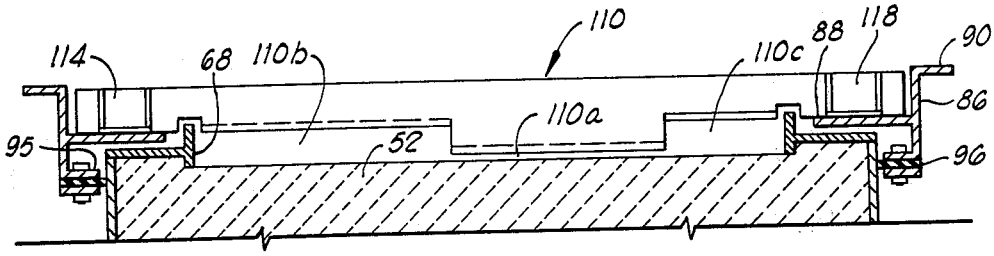
Figure 4:
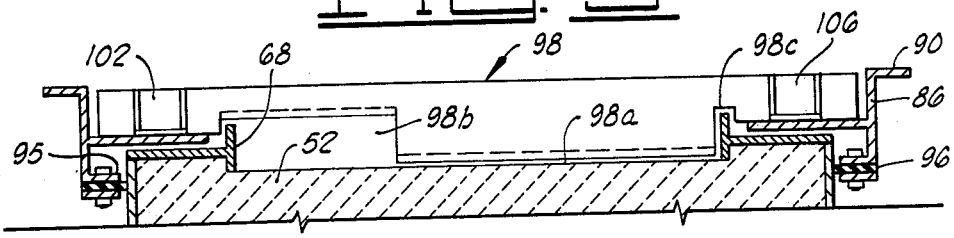
FIG. 4 is a sectional view taken along line 4—4 of FIG. 3.

Mounted over the turntable 70 by support of its opposite ends in the hood adapter 84 is a first or primary scraper blade designated generally by reference numeral 98, and illustrated in FIGS. 3 and 4. The primary scraper blade 98 is an elongated plate which extends across the generally circular turntable 70. One of the ends of the primary blade 98 is adjustably mounted between a pair of supporting brackets 100 and 102 which are located in a recess formed in the annular block of refractory material 92. The opposite end of the primary scraper blade 98 is adjustably mounted in a pair of engaging brackets 104 and 106 similarly mounted in a recess formed in the annular block of refractory material 92.

In viewing FIG. 4 of the drawings, it will be perceived that the primary scraper blade 98 is provided with a sharpened lower edge 98*a* which extends a major portion of the distance across the refractory table 52 along a chord thereof, and has a relatively large slot or relief 98*b* formed in one end of the blade. The blade 98 further has a slot or relief 98*c* formed therein at the other end of the edge 98*a* for accommodating the vertically extending sealing flange 68 formed at the inner periphery of the flange 66. It should be noted that the scraper blade 98 can be adjusted in its height above the turntable 70 as a result of the adjustability of the bracket engagement of its end portions. A secondary scraper blade 110 is mounted above the turntable 70, and, in the illustrated embodiment, extends substantially parallel to the primary scraper blade 98. The secondary scraper blade is engaged by bracket pairs 112–114 and 116–118, which are mounted in suitable recesses or slots formed in the annular block of refractory material 92 as hereinbefore described. The secondary scraper blade 110 is positioned much closer to the center of the turntable, and has the lower side of the blade relieved in the manner shown in FIG. 5. Thus, the blade 110 has a sharpened lower edge 110*a* disposed adjacent the lower side thereof and in relatively close proximity to the upper surface of the refractory table 52. A relatively elongated, but shallow, relief or slot 110*b* is formed in the blade 110 adjacent one end of the lower edge 110*a* and extends to the vertically extending sealing flange 68. A second, relatively shorter slot or recess 110*c* is cut into the other end of the blade 110 and extends along the blade to the place where the blade crosses the sealing flange 68. Like the primary scraper blade 98, the secondary scraper blade 110 is adjustably mounted in the brackets which support and engage its opposite ends so that the height or distance of the lower edge 110*a* above the surface of the refractory material on the turntable can be selectively varied.

The details of construction of the hood 26 are best illustrated in FIGS. 1 and 2. The hood 26 includes a metallic casing 120 which consists of a cover plate 120*a*, an annular side plate or rim 120*b* and a radially inwardly directed flange 120*c*. Projecting from the side plate 120*b*, and in alignment with the radially inwardly directed flange 120*c*, is a radially outwardly directed flange 120*d*. This flange facilitates the bolting of the hood 26 to the annular flange 90 of the hood adapter 24. Refractory material 122 lines the inside of the metallic casing 120 and defines an enlarged space 124 immediately over the exposed refractory material of the turntable 70.

Supported in the refractory material immediately beneath the cover plate 120*a* are a plurality of heaters or burners, illustrated schematically, and referred to by reference numeral 126 in FIG. 2. Where a plurality of fuel burners are employed, combustion air is supplied to the burners by a suitable forced draft combustion air blower 128. For the purpose of more efficiently controlling the temperature in the furnace, dilution air can be continuously drawn through the furnace by means of a fan 130. The amount of dilution air pulled through the furnace at any time is controlled by means of a control valve 132 connected in a line which enables a selected quantity of atmospheric air to be drawn through the fan. A charging duct 134 for charging the waste material to be incinerated to the furnace opens through the upper side of the hood 26 to facilitate the deposition on the turntable 70 of the waste material. The location of the charging duct 134 in relation to the primary and secondary scraper blades 98 and 110, and with respect to the upper surface of the turntable is illustrated by the dashed line circle depicted in FIG. 3.

Operation

In the operation of the rotary hearth furnace of the invention, the material to be incinerated, which can be sludge, feces, toilet paper, municipal refuse or other material, is first passed, either in bulk form, or after reduction in a comminutor, through the charging duct 134. The material is deposited on the upper surface of the refractory material 52 of the turntable 70 at a location immediately below the opening of the duct as shown in FIGS. 1 and 3. At this time, the refractory lined turntable is being slowly rotated. The drive to the turntable 70 originates at the motor 72 and is transmitted from the drive sprocket 82 to the sprocket 44 via the chain 84. Typically, the rate of rotation of the turntable 70 can be about three revolutions per hour.

The solid waste material charged to the turntable will usually contain a significant water content, making it flowable and of relatively low viscosity. It will thus tend to flatten into relatively thin beds on the turntable upon impact. As the turntable continues to rotate, the primary stationary scraper blade 98, which is preferably made of a heat-resistant alloy, controls the amount and rate of waste material passing through the slot 98*b* therein. The primary scraper blade 98 also regulates the depth of the waste material which passes to the opposite side of the primary scraper blade from that side to which the waste material is charged.

It will be noted from the chordal location of the primary scraper blade 98 with respect to the turntable 70, and as shown by the arrows representing the movement of the waste material in FIG. 3, that a large part of the waste material charged through the charging duct 34 moves in a clockwise direction and through the slot 98*b*. As the turntable continues to rotate, the waste material which is passed through the slot or relief 98*b* in the primary scraper blade 98 moves toward and through the relatively wide slot 110*b* in the secondary scraper blade 110. In comparing FIGS. 4 and 5, it can be seen that the height of the slot 110*b* is substantially less than that of the slot 98*b* so that there is a further reduction in the depth of the refuse on the upper surface of the turntable as the material passes through this elongated slot in the secondary scraper blade. It will also be noted in referring to FIGS. 3–5 that the waste material which has passed through the slot 98*b* in the primary scraper blade passes predominantly through the radially outer side of the slot 110*b* in the secondary blade, and thus remains relatively near to the outer periphery of the turntable 70.

With continued rotation of the turntable 70, that portion of the material which is relatively near to the outer periphery of the turntable will eventually encounter the slot 110*c* at the other end of the secondary scraper blade 110. That part of the waste material which passes through the slot 110*c* then continues to move with the turntable until this material, having been subjected to the high temperature within the furnace and substantially reduced by incineration, encounters the back side (that is, the side which faces generally toward the center of the turntable) of the primary scraper blade 98. Upon such contact, the waste material is deflected radially inwardly, and is at the same time further moved in a generally clockwise direction with the turntable movement. Thus, this material, which has now completed approximately 300° of travel with the turntable, is deflected inwardly to a position where it will be passed through the radially inner side of the slot 110*b* in the secondary scraper blade 110. It should be noted here that the point of introduction of the waste material to the turntable via the charging duct 134 is shielded or protected from the movement over this location of any of the material which has been carried through one rotation of the turntable so that a freshly uncovered or clean section of the hearth refractory material 92 is always newly presented for deposition of new and additional waste material on the turntable through the charging duct.

The waste material which is passed, in the course of its second revolution, through the radially inner side of the slot 110*b* in the course of its second revolution with the turntable, is then carried around in the clockwise direction until the inwardly facing back side of the secondary scraper bar 110 is encountered. At this time, this material, which has now been substantially completely reduced to ashes, is diverted or deflected into the center of the turntable where it is discharged through the central opening 54, and further, by gravity, through the bore 56 into the ash collector housing 12.

In a preferred operation of the rotary hearth furnace of the invention, the bed of material which is carried on the upper surface of the turntable 70 is subjected to a temperature of approximately 1800° F from the action of the burners or infra-red lamps which are mounted in the upper side of the hood 26. The heat source provided in the furnace is operated from a thermostatic control which automatically maintains the environment within the furnace at a high constant temperature. This insures that the waste material will "flash" or dehydrate almost instantaneously upon entering the interior of the furnace from the charging duct 134. In drawing a small amount of dilution air through the furnace by means of the fan 130, a slight vacuum is maintained in the furnace which prevents leakage of odorous gases from the furnace, and also improves the dehydration characteristics of the furnace by lowering the internal pressure below atmospheric pressure.

The turntable-to-hood interface is so designed, particularly by the provision of the sealing gasket 96, that a positive seal against the atmosphere is effectively achieved, thus providing a feature which allows precise adjustment of the volumes of air entering the combustion zone. Moreover, the provision of the vertically extending sealing flange 68 around the periphery of the refractory surface upon which the waste material is deposited assures that no disturbance of the material will result from any possible leakage of air past the sealing gasket 96, and also that the scraper blades 98 and 110 will not have the effect at any time of causing a pileup of ash material or partially incinerated waste to overflow the turntable and move out into the clearance space which separates the moving turntable 70 from the hood adapter 24.

As the material on the turntable rotates with the turntable through nearly 360° to a point adjacent the central outlet, the material is completely dried, reduced in volume, and in most cases, after 20 minutes exposure to intense heat, will have ignited. Moreover, contact with the back sides of the primary and secondary scraper blades in the manner hereinbefore described has the desirable effect of turning over the partially incinerated material to expose fresh surfaces to the heat source above, and the hearth refractory below. As the material completes its second circuit under the heat source, a total retention time in the incinerating environment of about 40 minutes is typically achieved for a 24 inch diameter hearth rotating at 3 revolutions per hour. At the end of this second revolution, the material has been very substantially reduced in volume, since all of the moisture has been evaporated and the combustibles in the waste material have been reduced to sterile ashes. Typically, the feed material charged to the incinerator, when consisting of human waste, may contain from 25 weight percent to about 50 weight percent solids which are reduced by approximately 90 percent as a result of combustion during the exposure occurring in two rotations of the turntable.

After the ashes have dropped through the central opening 54 and the bore 56 into the ash collector housing 12, they can subsequently be removed therefrom by lifting the sliding door 15 to obtain access to the interior of the housing. It should be noted at this point, that by lifting the vertically sliding door 15 of the housing 12, access can also be had via the ash collector housing to the screws which retain the annular thrust plate 60 on the lower end of the tube of refractory material 50. When the annular thrust plate 50 is removed, the thrust washer 62 can also be removed and the entire turntable then lifted out of its bearing structure after the hood 26 and hood adapter 24 have been removed. Thus, the vertical flange bearing 38 can be easily replaced, and any damage to the refractory material of the turntable 70 can be easily repaired at any time with very little down time of the apparatus being required. The location of the thrust bearings 47, 48 and 62 prevent the turntable 70 from riding upwardly or pitching vertically against the scraper blades 98 and 110 due to vibration, rolling or pitching of whatever platform or base the apparatus of the invention may be mounted on. It may be noted further that the gate 15 can be adjustably secured in any position so as to provide a variable area opening beneath the gate, thus allowing optional combustion air to be drawn through this opening under the sliding gate.

For packaged sewage treatment and sludge processing plant service, an ash receiver-mounting base that is smaller in diameter than that shown in the previously described embodiment, and which is open at the bottom, rather than at the side, can be optionally provided. The chute from the center of the turntable, carrying a flange at the bottom, is bolted to the open top of a settler, digester, or separator tank of a treatment plant. Using this system, after ashes pass from the rotary hearth furnace, a portion of them can be recycled. A part of the ashes will be dispersed into extremely small particles upon contact with cold water in the separator tank, and can be floated through standard solids separation equipment in suspension in the liquid effluent. This separated solid material, at this time, is completely inert and sterile, and can be safely discharged without violation of environmental pollution codes. About 4 ounces of each 2 pounds of ash which is recycled will be heavy residue, such as trace metals, calcium, potassium and the like. This residue is quenched and eventually settles into grit traps for periodic manual or continuous removal, depending upon the size and location of the unit. This heavy residue or grit amounts to about 90 pounds per year from a refractory hearth furnace unit constructed to accommodate and process the refuse from a 50-man crew, and this small amount of the dense, sterile slag, similar in physical character to sand, presents no problem of collection and disposal. Where the rotary hearth furnace is relatively small and is bolted to the upper side of a settler, digester or separator tank of a treatment plant, the advantage is also provided that the furnace constitutes an automatic vent for combustible gases vented from the subjacent digester or the like, and methane or similar burnable gases can be safely flared within the furnace as they are produced from the solid wastes.

The rotary hearth furnace can be designed with various changes effected therein from the structure shown in the preferred embodiment of the invention. The furnace can be provided with either larger or smaller turntables, with variations effected in the type of seal between the turntable and the hood adapter, and in the structural supports for the scraper blades, and in the use of multiple trunnion wheels for supporting the rotating hearth, instead of a single central flanged bearing built around the ash discharge chute, as in the illustrated embodiment. Moreover, the drive system can employ a variable speed electric motor or even hydraulic drives for infinite hearth speed control. The number of scraper blades used can be varied and, as previously pointed out, the size of the slots formed therein, and the distance which the scraper blades are located above the upper surface of the turntable can also be altered. In this way, the material which is deposited upon the turntable can be caused to undergo a multiplicity of circular traverses of the furnace prior to discharge through the central exit port.

By increasing the thickness and temperature rating of the refractory and insulation material, and by adding cooling water jackets internally in the furnace, the rotary hearth furnace can be adapted to extreme high temperature applications employing electric or plasma heat sources.

A preferred application and usage of the rotary hearth furnace of the invention is for marine installations where a sewage treatment facility sized to accommodate the refuse generated by a crew is required. Typically, in this application the rotary hearth furnace can be designed to accommodate the waste from 50 men. Other applications for which the apparatus should be useful include vacuum sewage systems, incineration of radio-active waste, sewage sludge drying, refinery sludge roasting to remove tetraethyl lead and other impurities, chemical drying and/or calcining.

Although a preferred embodiment of the invention has been herein specifically illustrated and described in detail, and several alterations or modifications of structure have been suggested, other innovations and changes can be effected in the described and illustrated structure without departure from the basic principles of the invention. Changes and innovations of this type are therefore deemed to be circumscribed by the spirit and scope of the invention except as the same may be necessarily limited by the appended claims or reasonable equivalents thereof.

What is claimed is:

1. A rotary hearth furnace comprising:

a refractory lined, generally circular turntable having a generally flat upper surface, and having a discharge opening in the center of said upper surface;

drive means drivingly engaging the turntable for driving the turntable in rotation;

hood means covering the turntable;

a primary scraper blade positioned over the turntable and within the hood means, said primary scraper blade extending chordally across said turntable at a location spaced radially outwardly from said discharge opening, and said primary scraper blade having a lower edge immediately adjacent the upper surface of said turntable extending part of the way across said turntable from the peripheral outer edge thereof, said primary scraper blade further having a slot therein at the lower side thereon and extending from one end of said lower edge toward a peripheral outer edge of said turntable; and a secondary scraper blade positioned over said turntable and within said hood means, said secondary scraper blade extending chordally across said turntable at a location spaced radially outwardly from said discharge opening, and spaced from said primary scraper blade, said secondary scraper blade having a lower edge immediately adjacent the upper surface of said turntable and extending part of the way across said turntable, said secondary scraper blade having a pair of slots therein at the lower side thereof, with said slots being spaced from each other by the lower edge of said secondary scraper blade, and with one of said slots positioned to permit material moving on said turntable as said turntable rotates to pass through said one slot and then engage said primary scraper blade at a location spaced therealong from the slot in said primary scraper blade;

means for depositing waste material to be incinerated through said hood means on said turntable at a location on the opposite side of said primary scraper blade from said secondary scraper blade and adjacent the portion of said primary scraper blade which carries said lower edge; and heater means in said hood means for directing heat against a waste material positioned on the upper surface of said turntable for incineration.

2. A rotary hearth furnace as defined in claim 1 wherein said hood means includes means adjustably supporting opposite ends of each of said scraper blades to facilitate the vertical elevation and lowering of said scraper blades in relation to the upper surface of said turntable.

3. A rotary hearth furnace as defined in claim 1 and further characterized as including means for preventing the turntable from moving or shifting upwardly or downwardly in relation to said scraper blades.

4. A rotary hearth furnace as defined in claim 1 and further characterized as including:

a mounting base-ash collector substructure positioned beneath said turntable and supporting said hood means; and means rotatably supporting said turntable on said substructure to prevent vertical movement of said turntable relative to said substructure and said hood means.

5. A rotary hearth furnace as defined in claim 4 wherein said hood means comprises:

hood adapter means supported on said substructure and extending around, and sealingly engaging, said turntable; and a hood removably secured to said hood adapter means and extending across the upper surface of said turntable.

6. A rotary hearth furnace as defined in claim 1 wherein said secondary scraper blade extends substantially parallel to said primary scraper blade, and wherein the slot formed in said primary scraper blade is deeper in a direction measured from the surface of the turntable to the bottom of said slot within said primary scraper blade, than the depth of the slots in said secondary scraper blade as similarly measured.

7. A rotary hearth furnace as defined in claim 4 wherein said means rotatably supporting said turntable on said substructure comprises:

a first sleeve secured to said substructure and projecting upwardly therefrom;
a second sleeve connected to said turntable;
bearing means between said first and second sleeves; and
a tube of refractory material within said second sleeve and having a bore therethrough communicating with the discharge opening in the center of the turntable.

8. A rotary hearth furnace as defined in claim 2 wherein said hood means comprises:
a hood adapter around said turntable and sealingly engaging said turntable, said hood adapter having said primary and secondary scraper blades adjustably supported therein; and
a hood removably mounted on said hood adapter.

9. A rotary hearth furnace as defined in claim 2 wherein said secondary scraper blade extends substantially parallel to said primary scraper blade, and wherein the slot formed in said primary scraper blade is deeper in a direction measured from the surface of the turntable to the bottom of said slot within said primary scraper blade, than the depth of the slots in said secondary scraper blade as similarly measured.

10. A rotary hearth furnace as defined in claim 5 wherein said hood adapter means comprises:
an annular rim extending around the outer side of said turntable;
a first flange projecting radially inwardly over said turntable from said rim;
refractory material secured to said first flange and defining a radially inwardly facing annular sealing shoulder sealingly cooperating with said turntable;
a second flange projecting radially inwardly toward said turntable from said annular rim and positioned below said first flange; and
an elastomeric, annular sealing gasket carried on said second flange and extending into sealing contact with said turntable.

11. A rotary hearth furnace as defined in claim 10 wherein said hood comprises:
a metallic casing;
refractory material lining the metallic casing and having said heating means mounted therein and positioned centrally over said turntable.

12. A rotary hearth furnace as defined in claim 4 wherein said substructure includes an ash collector housing having a vertically slidable door therein.

13. A rotary hearth furnace as defined in claim 12 and further characterized as including means mounted on said hood means for drawing dilution air under said vertically slidable door, up through said discharge opening in the center of the upper surface of said turntable and out of said hood.

14. A rotary hearth furnace as defined in claim 11 wherein said means rotatably supporting said turntable on said substructure comprises:
a first sleeve secured to said substructure and projecting upwardly therefrom;
a second sleeve connected to said turntable;
bearing means between said first and second sleeves; and
a tube of refractory material within said second sleeve and having a bore therethrough communicating with the discharge opening in the center of the turntable.

15. A rotary hearth furnace as defined in claim 14 and further characterized as including means adjustably supporting opposite ends of each of said scraper blades to facilitate the vertical elevation and lowering of said scraper blades in relation to the upper surface of said turntable.

16. A rotary hearth furnace as defined in claim 15 and further characterized as including means for preventing the turntable from moving or shifting upwardly or downwardly in relation to said scraper blades.

17. A rotary hearth furnace comprising:
a turntable having a flat, horizontally extending, upper surface, and having a gravity discharge opening in the center of the upper surface;
tubular means projecting vertically downwardly from the gravity discharge opening;
an ash collector housing below the turntable and receiving said tubular means, said housing having a hollow interior communicating with said gravity discharge opening via said tubular means;
bearing means around said tubular means connected to said ash collector housing and rotatably supporting said turntable and tubular means;
means between said bearing means and said turntable preventing said turntable from moving downwardly relative to said bearing means;
means between said ash collector housing and said bearing means preventing said turntable from moving upwardly relative to said bearing means and said ash collector housing;
scraper blade means mounted over said turntable and positioned to move refuse radially inwardly toward said discharge opening as said turntable is rotated; and
means drivingly connected to said turntable for rotating the turntable in said bearing structure.

18. A rotary hearth furnace as defined in claim 17 and further characterized as including a plurality of slotted scraper blades positioned over and extending chordally across said turntable relative to the rotating upper surface of said turntable, said scraper blades cooperating with the turntable during rotation to (a) move waste deposited on said upper surface first through a spiral path of decreasing radius, then along a path extending chordally across the top of said turntable, and thence into the discharge opening in the center of the upper surface of the turntable, and (b) to continuously clean said surface at a location beneath a fixed location in space over the rotating turntable.

19. A rotary hearth furnace as defined in claim 18 and further characterized as including hood means mounted over and sealingly engaging said turntable.

20. A rotary hearth furnace as defined in claim 19 and further characterized as including a charging duct extending through said hood means for depositing waste to be incinerated on said surface at the continuously cleaned location thereon.

21. A rotary hearth furnace comprising:
a substructure including an ash collector housing;
a generally circular turntable rotatably mounted on said substructure and including a vertically extending sealing flange;
an annular hood adapter mounted on said substructure and including:
an horizontally extending, annular elastomeric sealing gasket sealingly contacting the outer periphery of the turntable; and
an annular shoulder sealingly cooperating with said vertically extending sealing flange; and a hood detachably mounted on said annular hood adapter over said turntable.

22. A rotary hearth furnace comprising:

an ash housing having a door facilitating ingress to the interior of the housing;

a generally circular turntable;

a first sleeve secured to said ash housing and projecting upwardly therefrom;

sleeve means centrally secured to said turntable and extending concentrically downwardly within said first sleeve to rotatably support said turntable in said first sleeve, and providing a passageway to discharge ashes from said turntable to the interior of said ash housing; and retaining means within said ash housing and secured to said sleeve means for retaining said sleeve means in a fixed axial relation to said first sleeve, said retaining means being accessible through said ash housing door to facilitate detachment of the turntable from the ash housing.

* * * * *